US006862414B2

(12) United States Patent
Sampath et al.

(10) Patent No.: US 6,862,414 B2
(45) Date of Patent: Mar. 1, 2005

(54) AUTOMATED BANDING DEFECT ANALYSIS AND REPAIR FOR DOCUMENT PROCESSING SYSTEMS

(75) Inventors: Meera Sampath, Penfield, NY (US); Ronald M. Rockwell, Rochester, NY (US); D. Rene Rasmussen, Pittsford, NY (US); Ashok V. Godambe, Pittsford, NY (US); Eric Jackson, Penfield, NY (US); Raj Minhas, Webster, NY (US)

(73) Assignee: Xerox Corporation, Stamford, CT (US)

( * ) Notice: Subject to any disclaimer, the term of this patent is extended or adjusted under 35 U.S.C. 154(b) by 198 days.

(21) Appl. No.: 10/060,651

(22) Filed: Jan. 30, 2002

(65) Prior Publication Data

US 2003/0142985 A1 Jul. 31, 2003

(51) Int. Cl.[7] ..... G03G 15/00
(52) U.S. Cl. ..... 399/15; 382/112
(58) Field of Search ..... 399/9, 15, 42, 399/49, 72; 382/112; 358/406, 462, 300, 302

(56) References Cited

U.S. PATENT DOCUMENTS 4,335,952 A * 6/1982 Conly et al. ..... 399/11
5,138,377 A * 8/1992 Smith et al. ..... 399/11
5,365,310 A 11/1994 Jenkins et al.
5,884,118 A * 3/1999 Mestha et al. ..... 399/15
6,275,600 B1 * 8/2001 Banker et al. ..... 382/112
6,504,625 B1 * 1/2003 Amero et al. ..... 358/1.9
6,522,430 B1 * 2/2003 Dalal et al. ..... 358/406
6,529,616 B1 * 3/2003 Rasmussen et al. ..... 382/112
6,535,865 B1 * 3/2003 Skaaning et al. ..... 706/52
6,571,000 B1 * 5/2003 Rasmussen et al. ..... 382/112
6,597,473 B1 * 7/2003 Rasmussen et al. ..... 358/1.9
6,606,395 B1 * 8/2003 Rasmussen et al. ..... 382/112
6,665,425 B1 * 12/2003 Sampath et al. ..... 382/112

OTHER PUBLICATIONS

IQ Data Systems, A Division of GGX® IQ Analysis Engine Technical Overview, David Ting, Feb. 1, 1999, 10pp., Copyright 1998–1999.

* cited by examiner

*Primary Examiner*—Robert Beatty
(74) *Attorney, Agent, or Firm*—Perman & Green, LLP

(57) ABSTRACT

Using a system of computer modules operatively associated with a document processing machine, banding defect analysis is accomplished by analyzing specific test patterns via image processing. The banding defects are characterized in terms of quantitative parameters based on an analysis of the banding defect. Key features are extracted from the banding defect parameters. The key features are analyzed in a diagnostic engine, to determine the possible source of the defect. The identified source is correlated to a recommended repair service procedure. The diagnostic process may be augmented by also including machine data in the analysis.

49 Claims, 15 Drawing Sheets

| Failure Mode | Defect Presence | Defect Orientation | Defect Polarity | Defect Spread | Defect Separation |
|---|---|---|---|---|---|
| Normal | None | None | None | None | None |
| P/R Scratch | All Pages | Short Edge | Light | Isolated | Not-fuser-distance |
| Poor P/R Ground | CVT/Platen Page | Long Edge | Light | Isolated | Not-fuser-distance |
| Bad Charge Corotron | All Pages | Short Edge | Dark | Uniform | Not-fuser-distance |
| Damaged Cleaner Blade | All Pages | Short Edge | Light | Isolated | Not-fuser-distance |
| Damaged Fuser Finger | All Pages | Short Edge | Light | Isolated | Fuser-distance |
| Damaged Donor Roll | All Pages | Short Edge | Dark | Isolated | Not-fuser-distance |
| Contaminated Exposure | All Pages | Short Edge | Light | Isolated | Not-fuser-distance |
| Contam. CVT Glass | All Pages | Short Edge | Dark | Isolated | Not-fuser-distance |

FIG. 8

| FEATURE | PROBABILITIES | | | | |
|---|---|---|---|---|---|
| // | Normal | Contam_ cvt_glass | Failed_ charge_ corotron | Poor_ P/R_ ground | |
| // | N | F1 | F2 | F3 | F2F3 |
| "start_diagnoser" | 0.05 | 0.35 | 0.3 | 0.2 | 0.1 |
| "uniformity_test,pass" | 0.7 | 0.7 | 0.7 | 0.7 | 0.7 |
| "uniformity_test,fail" | 0.3 | 0.3 | 0.3 | 0.3 | 0.3 |
| "charge_test,pass" | 0.7 | 0.7 | 0.3 | 0.7 | 0.3 |
| "charge_test,fail" | 0.3 | 0.3 | 0.7 | 0.3 | 0.7 |
| "cleaner_test,pass" | 0.7 | 0.7 | 0.7 | 0.7 | 0.7 |
| "cleaner_test,fail" | 0.3 | 0.3 | 0.3 | 0.3 | 0.3 |
| "ros_test,pass" | 0.7 | 0.7 | 0.7 | 0.7 | 0.7 |
| "ros_test,fail" | 0.3 | 0.3 | 0.3 | 0.3 | 0.3 |
| "ground_test,pass" | 0.7 | 0.7 | 0.7 | 0.3 | 0.3 |
| "ground_test,fail" | 0.3 | 0.3 | 0.3 | 0.7 | 0.7 |
| "streak_present,yes" | 0.02 | 0.02 | 0.98 | 0.02 | 0.98 |
| "streak_present,no" | 0.98 | 0.98 | 0.02 | 0.98 | 0.02 |
| "streak_type_isolated_dark,yes" | 0 | 0.98 | 0.3 | 0 | 0.3 |
| "streak_type_isolated_dark,no" | 0 | 0.02 | 0.7 | 0 | 0.7 |
| "streak_type_isolated_light,yes" | 0 | 0.05 | 0.05 | 0 | 0.05 |
| "streak_type_isolated_light,no" | 0 | 0.95 | 0.95 | 0 | 0.95 |
| "streak_type_multiple_dark,yes" | 0 | 0.05 | 0.9 | 0 | 0.9 |
| "streak_type_multiple_dark,no" | 0 | 0.95 | 0.1 | 0 | 0.1 |
| "streak_type_multiple_light,yes" | 0 | 0.05 | 0.4 | 0 | 0.45 |
| "streak_type_multiple_light,no" | 0 | 0.95 | 0.6 | 0 | 0.55 |
| "streak_fuser_distance,yes" | 0 | 0.02 | 0.02 | 0 | 0.02 |
| "streak_fuser_distance,no" | 0 | 0.98 | 0.98 | 0 | 0.98 |
| "band_present,yes" | 0.02 | 0.02 | 0.02 | 0.5 | 0.5 |
| "band_present,no" | 0.98 | 0.98 | 0.98 | 0.5 | 0.5 |
| "band_type_dark,yes" | 0 | 0 | 0. | 0.3 | 0.3 |
| "band_type_dark,no" | 0 | 0 | 0 | 0.7 | 0.7 |

TO FIG. 9B

FIG. 9A

FIG. 9B

FROM FIG. 9A

| | | | | | |
|---|---|---|---|---|---|
| "band_type_light,yes" | 0 | 0 | 0 | 0.9 | 0.9 |
| "band_type_light,no" | 0 | 0 | 0 | 0.1 | 0.1 |
| "band_donor_roll_distance,yes" | 0 | 0 | 0 | 0.02 | 0.02 |
| "band_donor_roll_distance,no" | 0 | 0 | 0 | 0.98 | 0.98 |
| "band_mag_roll_distance,yes" | 0 | 0 | 0 | 0.02 | 0.02 |
| "band_mag_roll_distance,no" | 0 | 0 | 0 | 0.98 | 0.98 |
| "streak_on_cvt,yes" | 0.02 | 0.98 | 0.98 | 0.02 | 0.98 |
| "streak_on_cvt,no" | 0.98 | 0.02 | 0.02 | 0.98 | 0.02 |
| "streak_on_print,yes" | 0.02 | 0.02 | 0.98 | 0.02 | 0.98 |
| "streak_on_print,no" | 0.98 | 0.98 | 0.02 | 0.98 | 0.02 |
| "streak_on_white,yes" | 0.02 | 0.02 | 0.02 | 0.02 | 0.02 |
| "streak_on_white,no" | 0.98 | 0.98 | 0.98 | 0.98 | 0.98 |
| "streak_present_alternate_sheets,yes" | 0.02 | 0.02 | 0.02 | 0.02 | 0.02 |
| "streak_present_alternate_sheets,no" | 0.98 | 0.98 | 0.98 | 0.98 | 0.98 |
| "band_present_alternate_sheets,yes" | 0.02 | 0.02 | 0.02 | 0.7 | 0.7 |
| "band_present_alternate_sheets,no" | 0.98 | 0.98 | 0.98 | 0.3 | 0.3 |

| Failure Mode | Uniformity Test | Cleaner Test | Charge Test | ROS Test | Ground Test |
|---|---|---|---|---|---|
| Normal | Pass | Pass | Pass | Pass | Pass |
| P/R Scratch | Fail | Pass | Pass | Pass | Pass |
| Poor P/R Ground | Pass | Pass | Pass | Pass | Fail |
| Bad Charge Corotron | Pass | Pass | Fail | Pass | Pass |
| Damaged Cleaner Blade | Pass | Fail | Pass | Pass | Pass |
| Damaged Fuser Finger | Pass | Pass | Pass | Pass | Pass |
| Damaged Donor Roll | Pass | Pass | Pass | Pass | Pass |
| Contaminated Exposure | Pass | Pass | Pass | Fail | Pass |
| Contam. CVT Glass | Pass | Pass | Pass | Pass | Pass |

FIG. 10

| FEATURE | PROBABILITIES | | | | |
|---|---|---|---|---|---|
| // | Normal | Contam_ cvt_glass | Failed_ charge_ corotron | Poor_ P/R_ ground | |
| // | N | F1 | F2 | F3 | F2F3 |
| "uniformity_test,pass" | 0.7 | 0.7 | 0.7 | 0.7 | 0.7 |
| "uniformity_test,fail" | 0.3 | 0.3 | 0.3 | 0.3 | 0.3 |
| "charge_test,pass" | 0.7 | 0.7 | 0.3 | 0.7 | 0.3 |
| "charge_test,fail" | 0.3 | 0.3 | 0.7 | 0.3 | 0.7 |
| "cleaner_test,pass" | 0.7 | 0.7 | 0.7 | 0.7 | 0.7 |
| "cleaner_test,fail" | 0.3 | 0.3 | 0.3 | 0.3 | 0.3 |
| "ros_test,pass" | 0.7 | 0.7 | 0.7 | 0.7 | 0.7 |
| "ros_test,fail" | 0.3 | 0.3 | 0.3 | 0.3 | 0.3 |
| "ground_test,pass" | 0.7 | 0.7 | 0.7 | 0.3 | 0.3 |
| "ground_test,fail" | 0.3 | 0.3 | 0.3 | 0.7 | 0.7 |

FIG. 11

| Failure | Test |
|---|---|
| Contaminated CVT Glass | Streak_and_Band_Test, Streak_on_CVT_Test |
| Failed Charge Corotron | Streak_and_Band_Test, Machine_Test |
| Poor P/R Ground | Streak_and_Band_Test, Machine_Test, Streak_and_Band_2Sheet_Test |
| Scratched P/R I | Streak_and_Band_Test, Machine_Test, Streak_and_Band_2Sheet_Test |
| Scratched P/R II | Streak_and_Band_Test, Machine_Test |
| Damaged Cleaner Blade | Streak_and Band_Test, Machine_Test, Streak_on_White_Test |
| Donor Roll Run Out | Streak_and_Band_Test |
| Failed P/R Belt Charge Corotron | Streak_and_Band_Test, Streak_and_Band_2Sheet_Test |
| Damaged Fuser Finger | Streak_and_Band_Test |
| Mag Roll Run Out | Streak_and_Band_Test |
| Object Rubbing Donor Roll | Streak_and_Band_Test |
| Contaminated Donor Roll | Streak_and_Band_Test |
| Scanner Failure | Streak_and_Band_Test, Streak_on_Print_Test |
| Contaminated ROS Exposure | Streak_and_Band_Test, Machine_Test |

FIG. 12

| Failure | Test |
|---|---|
| Contaminated CVT Glass | "Clean CVT Platen Glass" |
| Failed Charge Corotron | "Replace Xerographic Unit" |
| Poor P/R Ground | "Replace Xerographic Unit" |
| Scratched P/R I | "Replace Xerographic Unit" |
| Scratched P/R II | "Replace Xerographic Unit" |
| Damaged Cleaner Blade | "Replace Xerographic Unit" |
| Donor Roll Run Out | "Place Service Call" |
| Failed P/R Belt Charge Corotron | "Replace Xerographic Unit" |
| Damaged Fuser Finger | "Replace Fuser Unit" |
| Mag Roll Run Out | "Place Service Call" |
| Object Rubbing Donor Roll | "Place Service Call" |
| Contaminated Donor Roll | "Place Service Call" |
| Scanner Failure | "Place Service Call" |
| Contaminated ROS Exposure | "Replace Xerographic Unit" |

FIG. 13

Machine Test: Cleaner Stress Test, Banding Test
Cleaner Stress Test Outputs: Cleaner Test Part1, Cleaner Test Part2
Banding Test Outputs: Banding Test Part1 Variation, Banding Test Part2 Variation Features to be Extracted: Cleaner Test Pass, Cleaner Test Fail
Algorithm used for Feature Extraction: Quadratic Classifier of the form $$D_i^2(x) = (x - m_i)' S_i^{-1} (x - m_i) + \mathrm{Ln}|S_i|$$

Where x = [Abs(Cleaner Test Part1 – Cleaner Test Part2)
Abs(sqrt(Banding Test Part1 Variation) – sqrt(Banding Test Part2 Variation))
sqrt(Banding Test Part2 Variation)]

m1, m2, S1, S2 are precomputed parameters m1 = Mean value of vector x for all data samples corresponding to a broken cleaner blade
m2 = Mean value of vector x for all data samples corresponding to a normally functioning cleaner blade
S1 = Covariance matrix computed for all data samples corresponding to a broken cleaner blade
S2 = Covariance matrix computed for all data samples corresponding to a normal cleaner blade
$|S_i|$ = Determinant of the covariance matrix $S_i$ D1 = Squared distance of x to Group 1 which corresponds Broken Cleaner Blade
D2 = Squared distance of x to Group 2 which corresponds Normal Cleaner Blade For a given x, if D1 < D2, Feature = Cleaner Test Fail; Else Feature = Cleaner Test Pass

FIG. 14

AUTOMATED BANDING DEFECT ANALYSIS AND REPAIR FOR DOCUMENT PROCESSING SYSTEMS

BACKGROUND OF THE INVENTION

1. Field of Invention

This invention relates to malfunction diagnosis of banding defects in document processing systems based on defect feature analysis and machine data analysis.

2. Description of Related Art

In document processing systems, it is well known that customer satisfaction can be improved and maintenance costs reduced if problems with copiers and printers can be fixed before they become serious enough to warrant a service call by the customer. Systems exist that enable printers and copiers to call for service automatically, when sensors detect certain operating parameters outside of permissible ranges. Generally, these systems take effect after a threshold has been reached where the degradation in image quality is directly observable by the user. Given the large number of operating parameters that need to be tracked during operation, a specific defect at a certain level may or may not be a significant problem. The overall affect of a specific defect depends on the cumulative values of the other parameters in the system. Systems do exist that attempt to diagnose failures in document processing systems based on image quality analysis of the print. Such a system for the diagnosis of copier performance over telephone lines is described in U.S. Pat. No. 5,365,310, incorporated herein by reference in its entirety.

A system and method for automatically diagnosing image quality defects is described in U.S. patent application Ser. No. 464,596, filed on Dec. 16, 1999, now U.S. Pat. No. 6,665,425 and commonly owned with the subject invention. The disclosure of this application is incorporated herein in its entirety. In this system, image quality problems occurring in a document processing system are identified by applying image processing and pattern recognition techniques to analyze specific test patterns. The results are analyzed in conjunction with known generic or experienced unit specific machine data in a diagnostic expert system to determine the cause of the problem. Further systems are provided to determine and execute a recommended service procedure, such as a user guided repair; scheduled maintenance service, parts replacement, and the like.

One of the most frequently encountered image defects is the banding defect which is symptomatic of a wide variety of malfunctions in the performance of a document processor. These defects manifest themselves as one or more lines, streaks, or bands extending across the document copy parallel to the short edge or the long edge, and may be periodic or non-periodic. They are caused by worn or damaged parts, foreign matter, electrical malfunctions, misalignment and other sources, within the print engine and the associated feed mechanisms and controls.

It is a purpose of the methods and systems described in this application to provide a means by which banding defects may be identified, analyzed, and quantified. It is a further purpose to diagnose a probable source of the defect and propose to the user an appropriate repair or correction.

SUMMARY OF THE INVENTION

The systems and methods of this invention provide automated diagnosis and repair of malfunctions in document processing systems based on a banding defect analysis.

The banding defect analysis is accomplished by using a series of computer modules and algorithms to analyze specific test patterns via techniques such as image processing and pattern recognition. As a result of analyzing the output of the document processor in response to specifically designed test patterns, the banding defects are characterized in terms of parameters that quantify the overall impairment of perceived image quality caused by the defect, as well as additional quantitative parameters that characterize the nature of the defect. The banding defect analysis is based on image analysis techniques including fourier analysis, filtering and human visual perception modeling.

Key features are extracted from the banding defect analysis output to provide data for determining possible sources of the defect. A series of algorithms for extracting predetermined features of the banding defects from the outputs of the banding defect analysis is stored. These algorithms utilize threshold values for such features and device specific specifications. Using these algorithms and the outputs of the banding defect analysis, the key features of a particular banding defect are established.

In order to diagnose the source of the defect the key features are subject to analysis in a diagnostic engine, such as a bayesian network, a neural network, or a model based or rule based, diagnostic engine to determine the probable source of the defect. The diagnostic engine utilizes a matrix of malfunctions and defect features symptomatic of a particular malfunction. Once a source malfunction is identified within a predetermined certainty by the diagnostic engine, it is submitted to a repair planning module which determines the recommended service. The repair module refers to a stored reference file or table which relates the identified source to the repair service.

The diagnostic system of this application, includes an image quality analysis module which identifies and characterizes a banding defect in terms of quantitative parameters and generates key features of the banding defect for further analysis. The output of the image quality analysis module is preprocessed for use in a diagnostic engine. The data is processed in diagnostic engine to correlate the key features of the banding defect to a malfunction which is the possible source of the defect. A recommended repair or service is selected by the repair planning module. The results are presented to the user through a user interface. A diagnostic controller controls and coordinates the operation of all of the modules. A memory is provided in operative association with the processing components of the diagnostic system to store the algorithms and data used in the analysis and diagnosis.

BRIEF DESCRIPTION OF THE DRAWING

The preferred embodiments of the invention will be described in detail, with reference to the following drawing in which:

FIG. 1(*b*) is a functional block diagram of a document processor system which is adapted for use with the diagnostic system of FIG. 1(*a*);

FIG. 8 is an example of a table of image quality feature values for banding defects;

FIG. 9 is an example of a table of image quality feature values for banding defects based on conditional probabilities of the features given the malfunctions;

FIG. 10 is an example of a table of machine data feature values for banding defects;

FIG. 11 shows an example of a table of machine data feature values for banding defects based on conditional probabilities of the features given the malfunctions;

FIG. 12 shows a sample test selection table for banding defects;

FIG. 13 shows a sample failure Repair table; and

FIG. 14 illustrates a sample algorithm for extraction of features from a given machine data set.

DETAILED DESCRIPTION OF PREFERRED EMBODIMENTS

As used in this application, document processing systems, include analog and digital copiers, printers, scanners, facsimiles, and multifunction machines. Said systems include those based on all direct and indirect marking technologies, both color and black and white, such as xerography, ink jet, liquid ink, lithography, and the like.

Figure 1A:
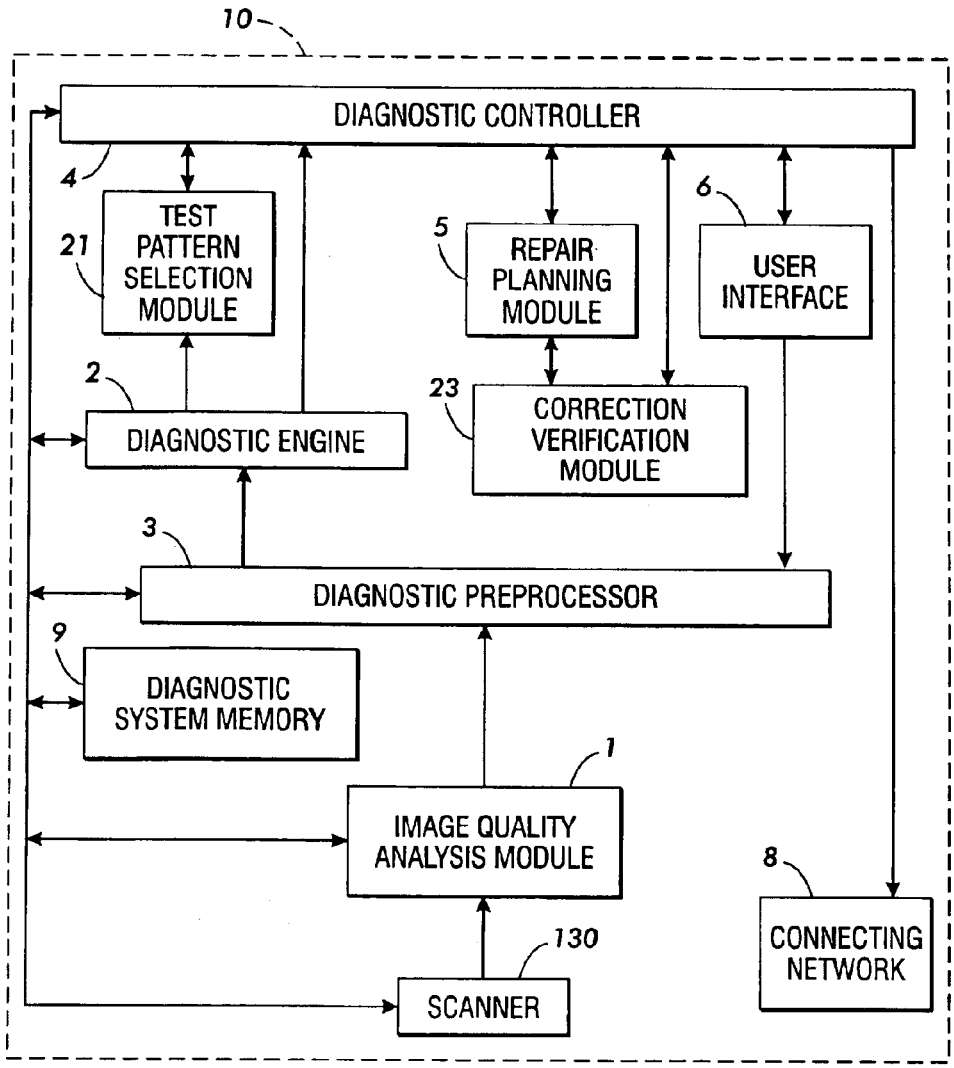
FIG. 1(*a*) is a functional block diagram illustrating an embodiment of a diagnostic system, according to the system of this application.
Figure 1B:
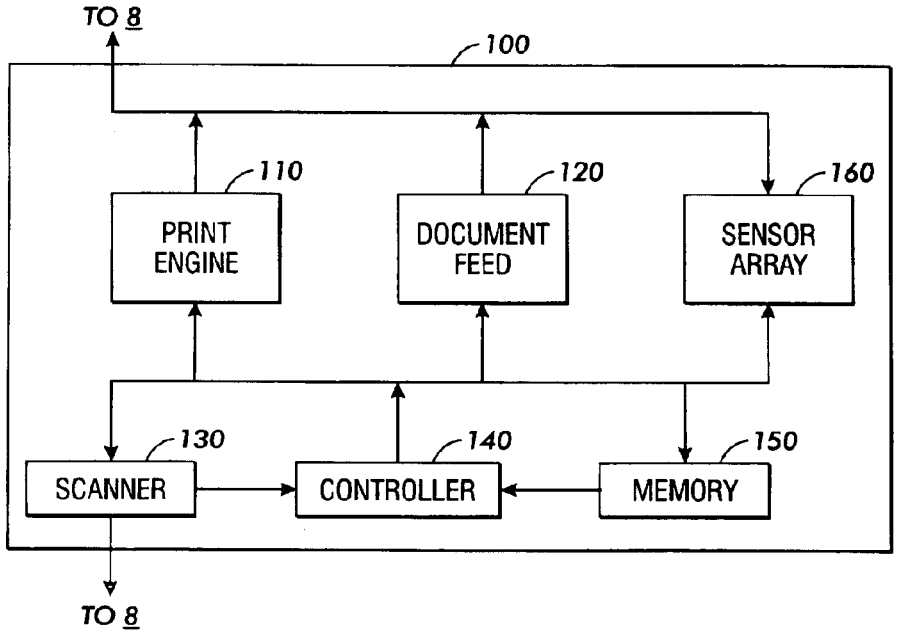

FIG. 1(*a*) illustrates an embodiment of a general purpose diagnostic system 10, adapted, according to the system of this application, to the analysis of banding defects. Banding defects are the most common image defect experienced in document processing systems and are the most frequent cause of service calls. The analysis of the lines, streaks, and bands which comprise banding defects is no easy task, as such defects can reflect some 30 to 40 malfunctions which may occur in a document processing system.

The diagnostic system 10 operates in association with a document processing system 100. The diagnostic system 10 can be part of a document processor, multifunction machine, printer, etc., or could be part of a general purpose computer server connected to the machine, or could be implemented as a stand alone appliance having appropriate plug in capability for operation with a variety of machines in many different environments. For illustration, the basic components of document processing system 100 are shown in FIG. 1(*b*) and consist of a print engine 110 which is served by a document feed 120 and a scanner 130. Scanner 130 could also be part of the diagnostic system 10, as shown in FIG. 1(*a*). In some instances, such as a stand alone appliance or where there is no scanner available in the document processing system, a separate diagnostic scanner could be used in addition to or instead of the scanner of the document processing system. A system controller 140 provides operating control of the system 100 in conjunction with memory 150. An array of sensors 160 is distributed throughout the system to monitor the performance of system 100 at key points. The sensors generate current system data which can be stored in memory 150 to provide historical and status data to assist in analysis of defects. Further system performance data can be obtained by monitoring operating signals and other characteristics of the document processing system 100. For simplicity such monitoring function is encompassed in the sensor array module for the purposes of this application.

As indicated above, the document processing system 100 can include a wide variety of components and architectures. The embodiment of FIG. 1(*a*) is presented only as an example for illustrating the operation of the banding defect analysis system of this application. The system of this application is intended for use with document processing systems in general.

The diagnostic system 10, as shown in FIG. 1(*a*), includes an image quality analysis module 1 which identifies and characterizes a banding defect in terms of quantitative parameters and generates key features of the banding defect for further analysis. Additionally, the user is prompted to input additional features describing the defect, such as for example, by the selection of one of a set of icons or images, or by answering a set of specific questions. The output of the image quality analysis module 1 and the user input data is adapted for use in a diagnostic engine 2 by a preprocessor 3. The data is processed in diagnostic engine 2 to correlate the key features of the banding defect to a malfunction which is a possible source of the defect. A probability of causation is be evaluated and a recommended repair or service is selected by the repair planning module 5. The results are presented to the user through user interface 6. User interface 6 may include a display screen and appropriate keypad (not shown).

The diagnostic controller 4 controls and coordinates the operation of all of the modules 1 through 7 and 21–23. A memory 9 is provided in operative association with the processing components of the diagnostic system 10 to store the algorithms and data used in the analysis and diagnosis. Memory 9 may also be adapted to track the operation of the diagnostic system 10, by logging and categorizing data. In this manner a historic data base of error correction may be maintained for future reference by diagnostic engine 2.

A test pattern selection module, as shown in FIG. 1(*a*), selects the appropriate test patterns to be copied or printed and subsequently scanned and the sequence in which the selected test patterns are to be copied or printed and scanned and analyzed. The sequence may be predetermined and stored as a look-up table, or, can be determined dynamically, during the diagnostic process based on optimizing criteria such as minimal number of sheets to scan, maximal discriminating power of the tests, or maximal accuracy of diagnosis. In addition, in specifying the test patterns and their sequence, the test pattern selection module may select the specific region of the scanned image to be analyzed, and the set of features that need to be extracted from the results of the banding defect analysis.

The diagnostic system 10, as shown in FIG. 1(*a*), is adapted to consider all of the data generated by the image quality analysis module 1 and eventually, using historical and experimental data relating to the causes of banding defects and data relating to the service fixes for such causes, present instructions to the user to accomplish a recommended service agenda.

At the end of a diagnostic cycle, after an automated repair system or the user have performed the appropriate repair action, the correction verification module 23 prompts the user or the system to run additional tests or print additional test prints to determine if the correction that was accomplished actually was successful in eliminating the banding defect. If not the user may be directed to perform additional repair actions or to contact service personnel.

Figure 2:
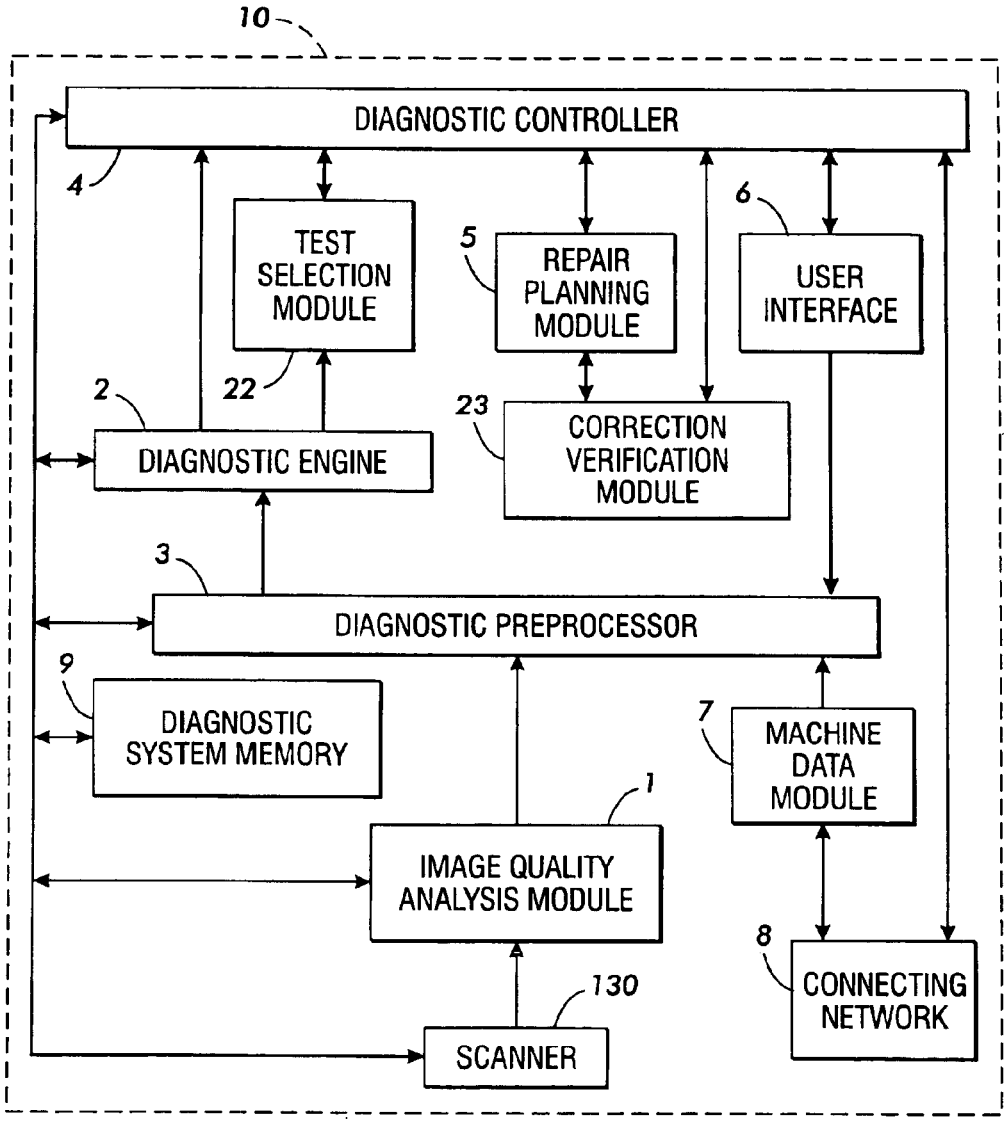
FIG. 2 is a functional block diagram illustrating an alternate embodiment of a diagnostic system, according to the system of this application.

In the alternate embodiment shown in FIG. 2, machine data module 7 is added to diagnostic system 10. Machine data module 7 is connected to receive data with respect to both current and historical operational experience with the document processing system 100. Such data may be obtained from sensor array 160, directly from monitored operational data from print engine 110 and document feed 120, from stored historical data, or from concurrently performed machine test procedures.

As part of the alternate embodiment, shown in FIG. 2, a test selection module 22 is used to select the appropriate sequence of banding defect tests and machine tests to be performed. For the banding defect analysis, the test selection module 22 selects the appropriate test patterns to be copied or printed and subsequently scanned and the sequence in which the selected test patterns are to be copied or printed and scanned and analyzed. In addition, the test selection module may select the specific region of the scanned image to be analyzed, and the set of features that need to be extracted from the banding metric. The test and sequence may be predetermined and stored as a look-up table, or, can be determined dynamically, during the diagnostic process based on optimizing criteria such as time needed to complete the test, maximal discriminating power of the tests, or maximal accuracy of diagnosis.

The components of the document processing system 100 are operationally interconnected by means of a bus system 170 and may be connected to the diagnostic system 10 by means of a connecting network 8. The components are shown for clarity as independent functional modules, but it should be noted that the related functions can be implemented by a central microprocessor with algorithms controlling the functions. In addition it should be appreciated that any one of, or a portion of the components of the diagnostic system can be located anywhere, including on the actual document processing system itself, on a distributed network, or an adjacent or remote diagnostics location. The flexibility of location could be implemented through the use of wired or wireless links or any other known or later developed element(s) that is capable of supplying electronic data to and from the connected elements. Furthermore, network 8 can be any one of, or combination of, a bus system, a direct serial connection, direct parallel connection, a distributed network such as an intranet, a local area network, a metropolitan area network, a wide area network, a satellite communication network, an infrared communication network, the Internet, or the like. Furthermore the diagnostic system 10 and the document processing system 100 may not be connected by any electronic means at all in particular in the embodiment of FIG. 1*a*), rather the information is transferred solely through print samples or copy samples being transferred in some fashion (automatically or manually) from 100 to 10.

Figure 3:
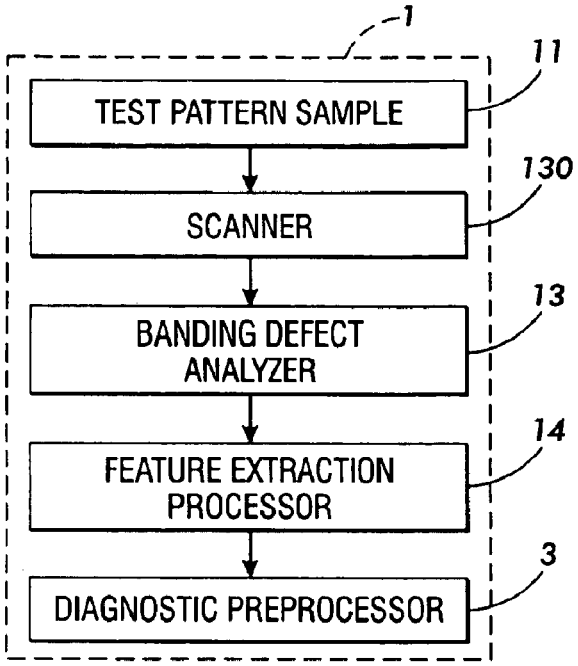
FIG. 3 is a functional block diagram showing an embodiment of the image quality analysis module, according to the system of this application.

As shown in FIG. 3, image quality analysis module 1 starts with a single test pattern or a series of test patterns 11 specifically designed to isolate a banding defect. Such patterns are well known and may consist of a uniform grey image or a series of uniform image segments at varying grey levels. The test patterns may further be hardcopy originals or original digital images. The test patterns are submitted to the document processing system 100 and copied one or more times in a variety of test sequences to provide data under varying circumstances, for example, with or without document feeder, enlarged or reduced, repetitive copies, and other steps which tend to isolate possible root causes of the banding defect. Alternately, or, in addition, the digital test patterns may be submitted as print jobs and printed using the print engine 110. The copy or print samples obtained from the scanner or the print engine, respectively, may be scanned, for diagnostic purposes, using either an external scanner or scanner 130 on the document processing system. The digital image data is analyzed to identify the presence of banding defects in banding defect analyzer 13.

Banding defect analyzer 13 is a computer module capable of executing image analysis algorithms available in memory 9. Banding defect analyzer 13 processes the image data to characterize the banding defect in terms of quantitative parameters. The image quality analysis module 1 analyzes the image, using commonly known image processing techniques such as, for example, Fourier transform analysis, band-pass filtering, histogramming, edge detection, 1-D projections, segmentation, classification, artifact detection, FIR filtering, wavelet analysis, statistical analysis, pattern recognition techniques, or the like, to evaluate image quality parameters and/or identify defects in the image(s). A typical banding defect analysis of the image data will provide data such as the following:

(i) One dimensional CIE Lab L* profile data in one or more directions (ii) FFT data FFT(L*)

(iii) L* profiles filtered through a human visual perception model, for example with a simple band pass filter ($L_f$—Visually filtered L*)

(iv) Visual Bands & Streaks VBS number which provides a measure of the overall impairment of perceived image quality caused by the banding defect (v) Locations and amplitudes of peak positive and negative deviations from average across the image of the L* signal (LSMinValue, LS MinLocation, LSMaxValue, LSMaxLocation)

(vi) Locations and amplitudes, of peak positive and negative deviations from average across the image, of the visually filtered $L_f$ signal (VFMinValue, VFMinLocation, VFMaxValue, VFMaxLocation)

It is to be noted that other signals related to visual perception such as reflectance values, or CIE XYZ values, or physical measurements such as reflectance values measured through scanner RGB filters may be used in place of the L* signal.

After the banding defect analysis is performed on a scanned image, further processing in feature extraction processor 14, determines/generates the key features of the banding defect based on predetermined defect characteristics stored in processor 14. These characteristics or features will be selected from a group, such as the following:

(i) Defect Presence (is a banding defect present or not?)

(ii) Defect Orientation (is the defect i.e., a short edge defect, or, i.e., long edge defect?)

(iii) Defect Spread (is the defect uniformly observed across the page, or is it isolated in one or more locations on the page?)

(iv) Defect Polarity (is the defect dark or light?)

(v) Defect Type: Defect Spread and Polarity (vi) Defect Separation (if multiple isolated defects are present, what is the separation between them?)

(vii) Defect Spectral Properties (is the defect observed in specific (known) frequencies?; is the defect present at high frequencies?)

(viii) Defect Change with Change of Gray level: (is the defect present in a dark image and not present in a light Image?/ is the defect light on a dark image and dark on a light image?)

(ix) Defect Enlargement/Reduction with Image (does the defect magnify (reduce) if the original image is magnified (reduced)?)

The extraction process is accomplished by executing a series of algorithms based on the banding defect analysis outputs. The basic steps of the analysis involve the comparison of the banding analysis outputs or quantities derived therefrom, to predetermined maximum or minimum thresholds and device specific specifications. Examples of device specific specifications include the distance between fuser fingers, diameter of the donor roll, and length of the photoreceptor pitch, in the document processing system whose malfunctions are to be detected. The extraction process algorithms are described in simple terms below to illustrate the analysis.

(i) Defect Presence: Check if the VBS number is greater than a given threshold. This threshold can be obtained from the IQ specifications for the copier/printer to be diagnosed, or by analyzing sample prints obtained from a copier/printer with no IQ related failures and obtaining the average VBS number over a set of prints. This algorithm can be used to check for the presence of the defect in images obtained by using different modes on the document processing system such as making a copy using the platen glass, making a copy using the automated document feeder, printing an internal test pattern, or printing an image submitted through the digital front end.

(ii) Defect Orientation: If the VBS number is greater than the threshold value for a segment of the scanned image that runs along the long edge of the sample print, then defect orientation=short edge; if the VBS number is greater than the threshold value for a segment of the scanned image that runs along the short edge of the sample print, then defect orientation=long edge.

(iii) Defect Type: Find the peak values within the L* peaks, or the visually filtered peaks, or, both (LSMinValue and LSMaxValue, or VFMinValue and VFMaxValue, or both) that exceed given thresholds. These thresholds can be predetermined fixed numbers, or can be based on the current image and can be equal to a significant statistic such as mean+3 std deviation, where the mean and standard deviation are computed over all Min and Max peak values across the image. Peak values that exceed the threshold will be characterized as "isolated defects". Further, depending on whether the peak is a negative(Minvalue) or a positive one (MaxValue), the Defect Type will be set to "IsolatedDark" or IsolatedLight". All peak values that do not cross the threshold to be marked as isolated defects but which still exceed a lower threshold will be marked as "potential defects". If the number of negative potential defects is greater than a specified threshold, then Defect Type="Uniform Dark"; If the number of positive potential defects is greater than a specified threshold, then Defect Type="Uniform Light";

(v) Defect Separation: Compute the distance between defects marked as isolated or potential by computing the difference between their locations (vi) Defect Spectral Properties: Check if the Fourier transform amplitudes at specific frequencies are significantly higher than average; check if the Fourier transform amplitudes are significantly lower at high frequencies.

(vii) Defect Change with Change of Gray level: Check if defect is present (as explained in (i) above) in a light image and not in a dark image and vice versa; Check if the defect polarity (as explained in (iv)above) changes from light to dark or vice versa in images of differing gray levels.

(viii) Defect Enlargement/Reduction with Image: Compare the size of the defect in two images, one obtained by copying an original image (on the machine to be diagnosed) at one magnification level and the second obtained by copying the original at a higher/lower level of magnification. If the defect size is greater (lesser) with enlargement (reduction), defect is said to enlarge (reduce) with image.

The extracted features are converted to a format acceptable to the particular diagnostic engine used, for example event format, in diagnostic preprocessor 3 and submitted to the diagnostic engine 2 for additional analysis. Diagnostic engine 2 is a computer module capable of executing algorithms which apply reasoning techniques such as qualitative reasoning, probabilistic reasoning, or fuzzy reasoning, and could be rule based, object based, or model based, or case based. A bayesian network is used in the preferred embodiment, but it should be noted that the system could be adapted to other forms of diagnostic algorithms. The output of the diagnostic engine 2 is sent to the diagnostic controller 4 for correlation with a repair scheme from repair planning module 5 and presentation to the user via user interface 6.

In order to provide the diagnostic engine 2 with data from which to correlate particular extracted features with a particular malfunction which may cause the particular defect, a matrix of malfunctions is compiled with the likely defects that would result. For example in a particular document processing system the following malfunctions may occur which might result in a banding defect:

(i) Photo Receptor Scratch (F1)

(ii) Poor PhotoReceptor Ground (F2)

(iii) Contaminated Charge Corotron (F3)

(iv) Damaged Cleaner Blade (F4)

(v) Contaminated Exposure Slot (ROS) (F5)

(vi) Damaged Donor Roll (F6)

(vii) Damaged Fuser Finger (F7)

(viii) Contaminated CVT Glass (F8)

To isolate the resulting banding defect, a test pattern having a uniform gray image, at a certain area coverage is scanned using several variations of steps. Since some of the defects caused by one or more of the above malfunctions only appear in alternate copies or only when the document feeder is used, the user is directed to make two sequential copies of the selected test pattern and also to make copies with and without the document feeder.

A damaged fuser finger, for example, will cause repetitive streaks separated by a specific distance which correlates to the distance between the fuser fingers. Therefore, in analyzing the defect separation feature, this malfunction can be readily identified or eliminated depending on the value of defect separation. If such a malfunction is one of the set of malfunctions that the diagnostic system is designed to detect, then separation between defects would be extracted as a key feature.

A matrix of such defect data based on experience with a fleet of document processors or with a particular processor can be compiled for use by the diagnostic engine 2. An example of such a matrix is shown in the table of FIG. 8. When the diagnostic engine used is a probabilistic one, such as a bayesian engine, the table includes conditional probabilities of the defect features given the malfunctions, as well as a prior probabilities of the malfunctions. An example of a defect feature matrix with probabilities is shown in FIG. 9.

The diagnostic engine 2 performs the task of reasoning with the multiple sources of information to isolate the cause of the malfunction indicated by the banding defect. This can be an iterative process, for example, test pattern selection module 21 may decide, based on an initial diagnosis, that additional test patterns are to be scanned. In addition certain specific image quality parameters may be emphasized for evaluation and specific defect features may be extracted in order to further isolate the malfunction.

In the embodiment of FIG. 1(*a*) Test pattern selection module 21 may be based on a simple look-up table that maps malfunctions to specific test patterns or it may be based on an optimization scheme. When the test pattern selection module is implemented as a simple lookup table, at any time during the iterative diagnostic process, the malfunction that appears most probable at that point may be chosen and a test pattern associated with that malfunction will be chosen as the next test pattern to scan and analyze. Where there is more than one test pattern associated with a failure, the test patterns will be scanned and analyzed in the order in which they are listed in the table, with the constraint that any test pattern scanned and analyzed already will not be repeated. In a case where the test pattern selection module is based on an optimization scheme, the next test pattern chosen will be that particular test pattern among the given set of test patterns that maximizes an optimization criteria, for example: the test pattern that maximizes the entropy function, provides the best discriminating information to isolate the malfunction, minimizes the time taken to reach a diagnosis, or minimizes the overall cost of running the diagnostic system, or a combination of the above.

Based on the test pattern chosen by the test pattern selection module, the document processing system 100 is directed to produce one or more print samples of an original test pattern stored either in its internal memory, or on a network drive in a distributed network environment. The print samples are then forwarded to the scanner 130 or the external scanner for digitizing. Alternately, the customer, the customer service engineer, or the like, can make copies of hard copy original test patterns and then scan them.

Figure 7A:
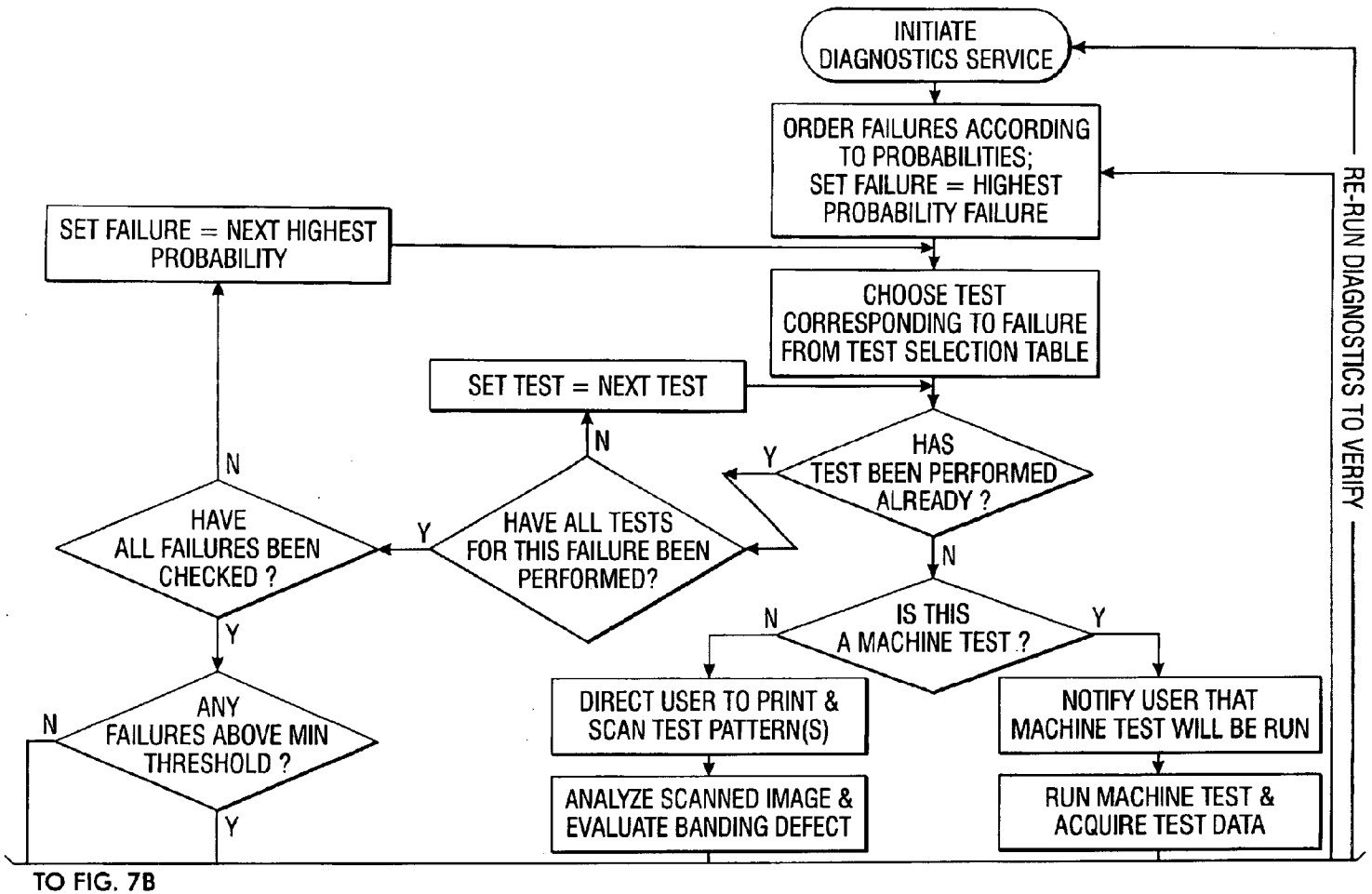
FIG. 7 is a workflow diagram showing an alternate embodiment of the method of the system of this application using banding defect analysis with machine data analysis.
Figure 7B:
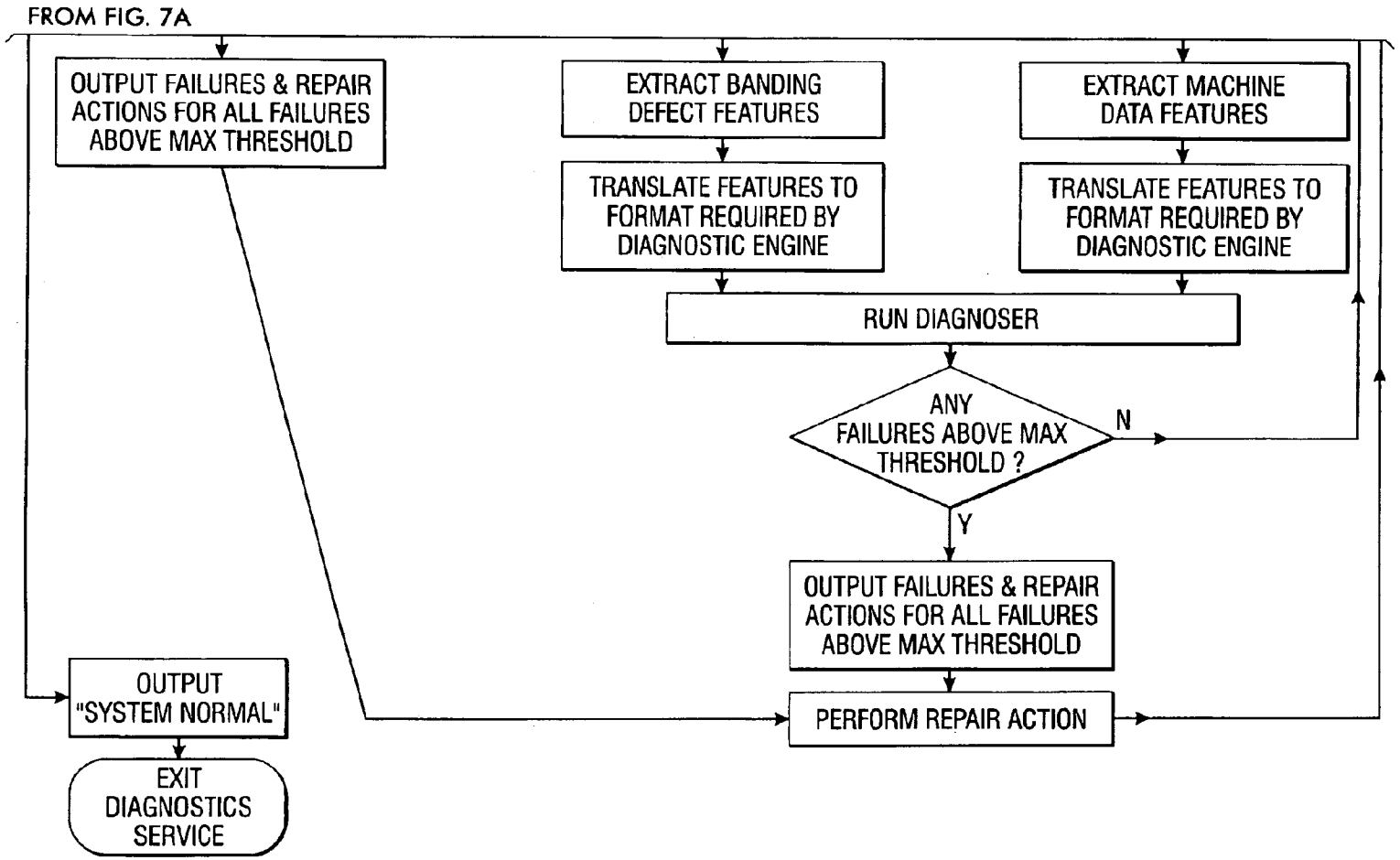

Alternately, in the embodiment of FIG. 2 in which the banding defect data is augmented with machine data obtained from sensor array 160, to provide better diagnosis of malfunctions, as illustrated in FIGS. 2 and 7, the test selection module 22 may decide that additional data must be collected from the document processing system to refine the current list of probable malfunctions obtained by analysis of the image data.

As in the case of the test pattern selection module 21, the test selection module 22 may be based on a simple look-up table that maps malfunctions to specific tests or it may be based on an optimization scheme. When the test selection module is implemented as a simple lookup table, at any time during the iterative diagnostic process, the malfunction that appears most probable at that point may be chosen and a test associated with that malfunction will be chosen as the next test to perform. Where there is more than one test associated with a failure, the test will be performed in the order in which they are listed in the table, with the constraint that any test performed already will not be repeated. FIG. 12 shows a sample test selection look-up table. In a case where the test selection module is based on an optimization scheme, the next test chosen will be that particular test among the given set of tests that maximizes an optimization criteria, for example: the test that maximizes the entropy function, provides the best discriminating information to isolate the malfunction, minimizes the time taken to reach a diagnosis, or minimizes the overall cost of running the diagnostic system, or a combination of the above.

The machine data obtained from the document processor may include machine operational data such as set point, actuator, and sensor data collected during regular operation of the machine, machine usage data, historical data such as fault counters and performance data. Such data may be obtained directly from the print engine 110, document feed 120, and other components of the document processor 100, from the sensor array 160, or from the memory 150. In addition, a set of special diagnostic or performance tests may be run on the document processing machine 100 and the effects of the tests can be observed on sensor array 120. Examples of such tests are described in U.S. Pat. Nos. 5,864,730; 5,893,008; 5,903,796; 5,937,224; 5,960,228; 5,946,521; 5,995,775; 6,016,204; 6,081,348; and 6,198,885, commonly owned with this application, the disclosure of which being incorporated herein in its entirety. The diagnostic tests typically are stress tests on the various components that for example, vary the actuators between maximum and minimum values. Examples of such diagnostic tests include but are not limited to photoreceptor uniformity tests, cleaner stress test, charge system stress tests, exposure system tests, development system tests, banding test on the photoreceptor and reload test on the photoreceptor. This data can be supplied to the machine data module 7 and may be factored into the analysis performed by diagnostic engine 2.

Machine data module 7 is added to the diagnostic system for this purpose and provides the mechanism to collect and deliver machine data to diagnostic preprocessor 3 for consideration in the analysis performed by diagnostic engine 2. The machine data processor 19 generates a set of high level features from the machine data based on analysis of the machine data. The generated features diagnostic are converted to a format acceptable to the particular diagnostic engine used, for example event format, in diagnostic preprocessor 3. Some sample machine data features are listed below.

(i) Uniformity Test: This feature is based primarily on the photoreceptor uniformity test data collected from the machine and is used to identify the presence of non-uniformity's such as scratches on the photoreceptor. This feature takes on values "Pass" or "fail".

(ii) Charge Test: This feature is used to identify charge corotron problems that may result in banding defects. It is based typically on the output of the charge stress test data. This feature takes on values "Pass" or "fail".

(iii) Cleaner Test: This feature is used to identify cleaner blade problems that may result in banding defects. It is based typically on the output of the cleaner stress test data. This feature takes on values "Pass" or "fail".

(iv) ROS Test: This feature is used to identify Ros exposure contamination problems that may result in banding defects. It is based typically on the output of the ROS stress test data. This feature takes on values "Pass" or "fail".

(v) Ground Test: This feature is used to identify photoreceptor ground problems that may result in banding defects. It is based typically on the output of the banding test data. This feature takes on values "Pass" or "fail".

Examples of machine data features and their correlation to malfunctions are shown in FIG. 10. A sample machine data feature matrix with conditional probabilities is shown in FIG. 11.

The algorithms for extraction of the machine data features from the raw machine data are based on statistical analysis techniques, including, discriminant analysis, classifiers and regression analysis, and data mining techniques, including, decision trees and the like. The parameters of these tests are predetermined by analysis of machine data corresponding to the various malfunctions as well as data from a normal machine with no malfunctions. These parameters are stored in the machine data processor. The machine data generated during any run of the proposed diagnostic system is analyzed using these predetermined parameters and the feature values are determined.

FIG. 14 illustrates a sample algorithm for extraction of features from a given machine data set. In this example, the machine data used is the output of the cleaner stress test and the banding test, and the features extracted are "Cleaner test pass" and "Cleaner test fail". A discrimnant analysis based quadratic classifier is used to generate the features from the cleaner stress test data and the banding test data.

Processing in preprocessor 3 may also involve conversion of analog data, received from one or more sensors, into qualitative values. Alternatively, it may involve translating machine signals into discrete event sequences, as described in U.S. application Ser. No. 60/154,016, commonly owned with this application, the disclosure of which being incorporated herein in its entirety. The event sequences are recognized by the diagnostic engine 2.

The features generated by the machine data processor and formatted by the diagnostic preprocessor are passed on to the diagnostic engine 2 to be used in conjunction with the defect features for isolating the malfunction.

Figure 4:
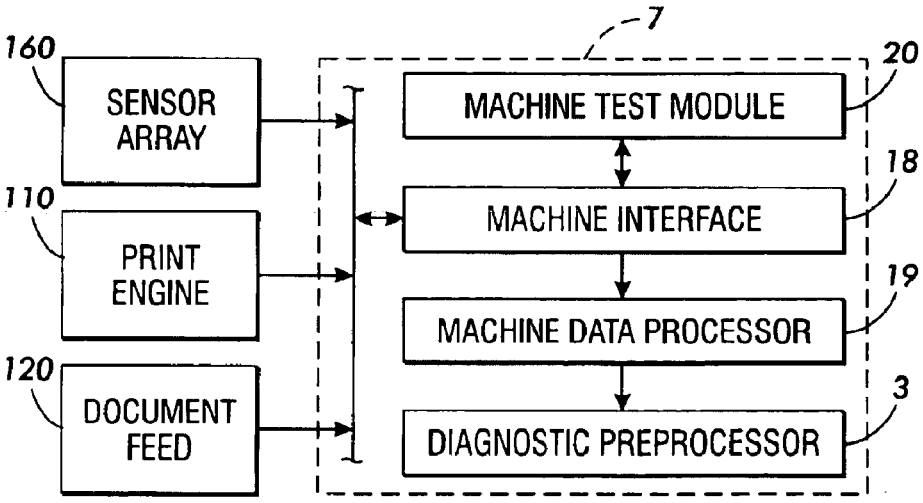
FIG. 4 is a functional block diagram showing an embodiment of a machine data module, according to the system of this application.

Machine data module 7 may take on a variety of architectures depending on the means by which the data is collected, an example of such a module is shown in FIG. 4. In FIG. 4 a machine interface 18 is a computer element which is programmed to receive data, such as historical data, signals from sensor array 160 and raw signals indicative of various operational status and events from the print engine, document feed and other components of document processing system 100. In some instances it may be desirable, as a result of an initial analysis, to run particular diagnostic tests to further isolate a suspected malfunction. This may be accomplished by machine test module 20 through machine interface 18 and controller 140 or directly through specific system components and the results of the tests may be received through sensor array 160 or memory 150. While the machine test module is shown to be part of the diagnostic system 10 in this embodiment, it may alternately be part of the document processing system 100. The data that is received from the interface 18 is processed in machine data processor 19 and features of the machine data are extracted for transmittal to preprocessor 3.

Figure 5:
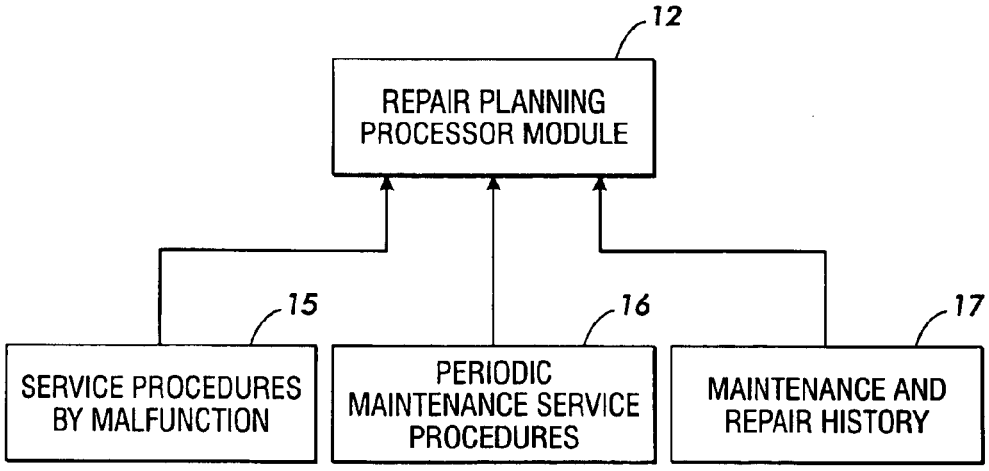
FIG. 5 is a functional block diagram showing an embodiment of a repair planning module, according to the system of this application.

The output of the diagnostic engine 2 is received by the repair planning module 5 for selection of the appropriate service procedure which will correct the malfunction identified in analysis. An example of repair planning module 5 is shown for illustration in FIG. 5. Memory 15 contains a table of repair procedures correlated with specific malfunctions which can be presented for selection by repair planning processor 12. In certain instances, it may be advantageous to review the scheduled maintenance service procedures stored in memory 16 for the purpose of accelerating such service to fix the malfunction. In addition memory 17 provides access to a systems history to allow the replacement of parts where warranted. The repair procedures may be performed by the customer, system administrator, key operator, or the like, or by certified service personnel. FIG. 13 shows a sample repair action table for a set of malfunctions. In this manner a probability of causation of a malfunction based on the key features can be calculated with a significant degree of accuracy and used to identify a repair which is likely to correct the banding defect.

It should be noted that the above description identifies the components of the diagnostic system as separate functional modules. These functions can be implemented by a wide variety of computer elements, for example, a special purpose computer, a programmed microprocessor or microcontroller, a peripheral integrated circuit element, such as an ASIC, a digital signal processor, a hard-wired electronic or logic circuit, such as a discreet element circuit, a programmable logic device such as a PLD, PLA, FPGA, PAL, or in general, any device capable of implementing the functions described herein.

The basic operation of the system of this application involves performing banding defect analysis on a print or copy sample of a special test pattern. Based on the output of the banding defect analysis, the presence of a defect (or set of defects) is detected and further, the defects are characterized by a set of quantitative parameters. Further processing of the banding defect analysis outputs is performed to extract the key features of the banding defects. The extraction of said key features is based on a a series of algorithms which utilize threshold values of the features and device specific specifications.

The key features are analyzed in a diagnostic engine. This results in the computation of the most likely malfunctions among various malfunctions for a given set of key feature values. The process of analysis can be repeated through iterations designed to isolate the most probable malfunction based on a refined set of key feature values. The iterative process can consider image data, machine data, or user input data. A predetermined value of certainty can be set for the purpose of comparison and screening of the probable malfunctions. The analysis is deemed successful upon the selection of a malfunction having a certainty above a preset threshold certainty level. From this data, a suitable service procedure is selected designed to correct the malfunction. If the analysis fails to achieve the threshold of certainty, then a list of most probable causes given the analysis up to that point is displayed with suitable service procedure recommendations. If no malfunction is perceived, then the diagnostic service is aborted and the user is notified.

Figure 6:
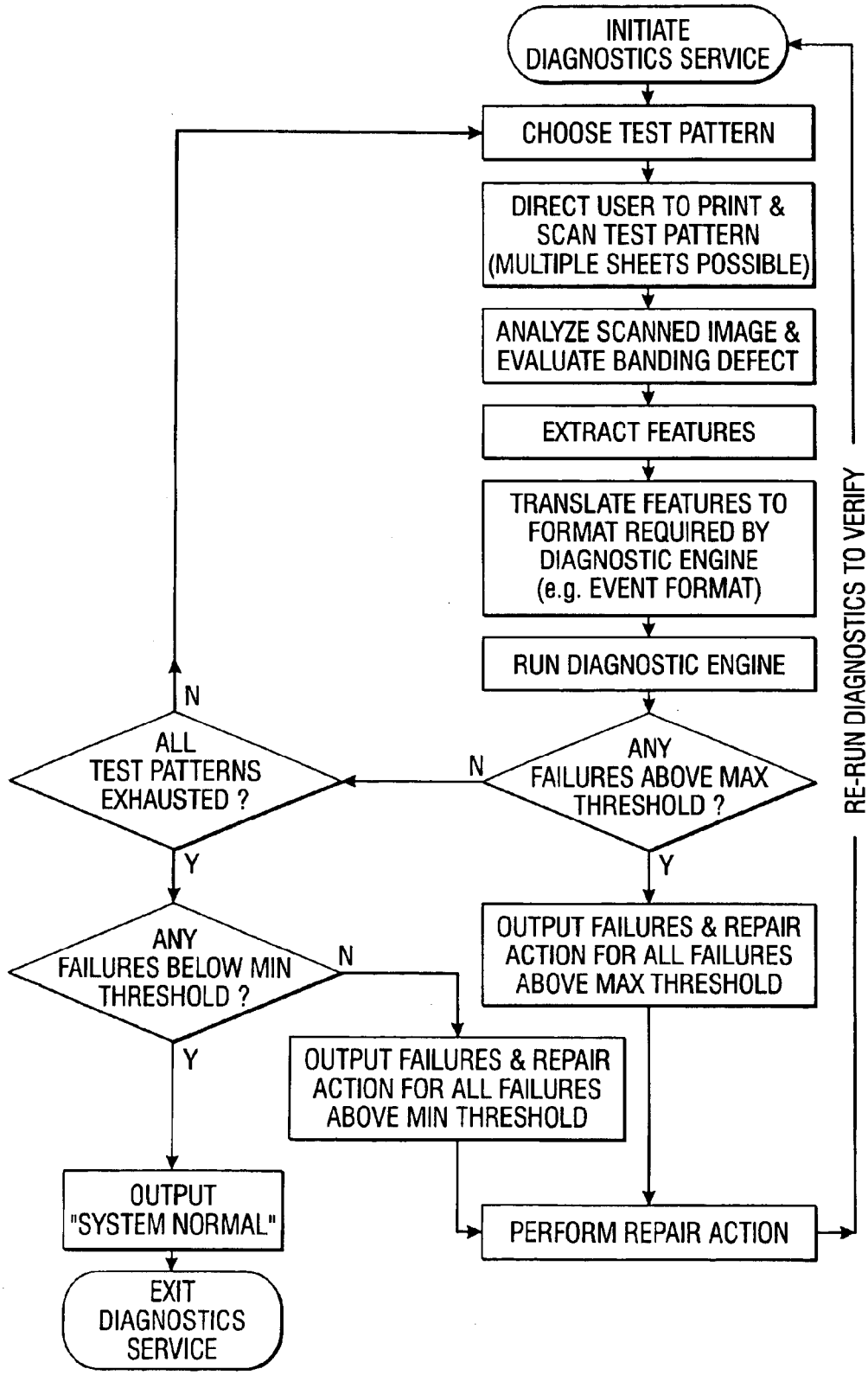
FIG. 6 is a workflow diagram showing an embodiment of the method of the system of this application using banding defect analysis.

As shown in FIG. 6, the process is started by initiating the diagnostic service. This activation can be manually started by the user after observation of banding defects on a document, automatically, as the result of image monitoring, or periodically according to service procedures. To first determine the presence of a banding defect, the user or system initiates the copying or printing of a specially designed test pattern followed by scanning the copy or print sample. The resulting image data is analyzed through the above steps to determine if there is a defect. This would be shown, for example, by certain elements of the banding defect analysis output exceeding threshold values or machine specific specifications. If no defect is found the diagnostic service is complete and the user is notified to exit to normal operation or to contact service personnel depending on whether the diagnostic system was invoked after the user observed a banding defect or not.

The analysis process can cycle through a series of iterative steps by having a variety of test patterns available in storage. In addition the test patterns can be run in different settings or using different components to isolate the malfunction. Instructions can be presented to the user through the user interface or the cycles can be accomplished automatically as instructed by the diagnostic controller 4.

The diagnostic data can be supplemented by machine data as previously described. As shown in the steps of FIG. 7, the machine data can be collected and analyzed sequentially, prior to, or after, the collection and analysis of the banding defect image data.

In this manner a system and method of servicing a document processing machine is provided without relying on a service technician or other external process. This will result in considerable savings of time and cost. The system and method described herein can readily be adapted for significant automatic control.

While the invention has been described with reference to specific embodiments, the description of the specific embodiments is illustrative only and is not to be construed as limiting the scope of the invention. Various other modifications and changes may occur to those skilled in the art without departing from the spirit and scope of the invention as defined by the claims.

What is claimed is:

1. A diagnostic system for diagnosing the cause of banding defects in a document processing system comprising:

a scanner far generating image data by digitizing hardcopy samples obtained by printing or copying a test pattern on said document processing system;

an image quality analysis module adapted to receive said image data and to detect the presence of banding defects, said image quality analysis module further analyzing said image data relating to a detected banding defect to obtain quantified parameters of said banding defect and extradting key features from said quantified parameters;

a diagnostic engine adapted to receive and analyze said key features, said diagnostic engine further identifying one or more malfunctions which are possible causes of said defect based on said analysis of said key features, through iterative cycles of analysis based on one or more test patterns;

a repair planning module adapted to receive the malfunctions identified by said diagnostic engine and select, from a plurality of service procedures1 one or more of said procedures which are likely to correct said malfunction;

a memory module for storing data and algorithms relating to said diagnostic system;

a diagnostic control module adapted to control and coordinate the operation of said modules.

2. A system for diagnosing the cause of banding defects in a document processing system, as described in claim 1, wherein said scanner is a component of the document processing system.

3. A system for diagnosing the cause of banding defects in a document processing system, as described in claim 1, wherein said repair planning module further causes said selected service procedure to automatically be performed in said document control system.

4. A system for diagnosing the cause of banding defects in a document processing system, as described in claim 1, wherein said repair planning module further causes said selected service procedure to be presented to a user of said document processing system through a user interface, wherein said user may cause said selected service procedure to be performed in said document control system.

5. A system for diagnosing the cause of banding defects in a document processing system, as described in claim 1, wherein said image quality analysis module applies one or more methods selected from the group consisting of fourier analysis, filtering, and visual perception analysis to said image data to generate said banding defect analysis output.

6. A system for diagnosing the cause of banding defects in a document processing system, as described in claim 4, wherein said image quality analysis module further applies a series of algorithms which use said banding defect parameters and predetermined threshold values of such parameters to extract said key features from said banding defect parameters.

7. A system for diagnosing the cause of banding defects in a document processing system, as described in claim 1, wherein said diagnostic engine applies reasoning techniques to said key features to identify causation of said defects.

8. A system for diagnosing the cause of banding defects in a document processing system, as described in claim 1, wherein said diagnostic engine calculates the probability of causation for a plurality of malfunctions in said system for said key features to identify one or more malfunctions which are possible causes of said defect.

9. A system for diagnosing the cause of banding defects in a document processing system, as described in claim 8 wherein said diagnostic engine applies a bayesian analysis to said key features to calculate said probabilities of causation.

10. A diagnostic system for diagnosing the cause of banding defects in a document processing system comprising:

a scanner for generating image data by digitizing hardcopy samples obtained by printing or copying a test pattern on said document processing system an image quality analysis module adapted to receive said image data and to detect the presence of banding defects, said image quality analysis module further analyzing said image data relating to a detected banding defect to obtain quantified parameters of said banding defect and extracting key features from said quantified parameters;

a diagnostic engine adapted to receive and analyze said key features, said diagnostic engine further identifying one or more malfunctions which are possible causes of said defect based on said analysis of said key features;

a repair planning module adapted to receive the malfunctions identified by said diagnostic engine and select, from a plurality of service procedures, one or more of said procedures which are likely to correct said malfunction;

a memory module for storing data and algorithms relating to said diagnostic system;

a diagnostic control module adapted to control and coordinate the operation of said modules; and a test pattern selection module that determines the next test pattern to be printed or copied and then scanned and the next set of features to be evaluated during successive diagnostic process cycles.

11. A system for diagnosing the cause of banding defects in a document processing system, as described in claim 1, wherein said diagnostic system memory has data stored therein relating to banding defects, and a series of algorithms, said algorithms generating said key features from said banding defect quantified parameters using threshold values for such parameters and device specific specifications.

12. A system for diagnosing the cause of banding defects in a document processing system, as described in claim 1, wherein said memory stores data relating to causes of banding defects correlated to banding defect features indicative of said causes, for use by said diagnostic engine in the identification of said one or more malfunctions.

13. A system for diagnosing the cause of banding defects in a document processing system, as described in claim 10, wherein said memory stores data relating to causes of banding defects correlated to test patterns capable of providing banding defect features indicative of said causes, for use by said test pattern selection module in the choice of the test pattern to be scanned.

14. A system for diagnosing the cause of banding defects in a document processing system, as described in claim 1, further comprising a machine data module for compiling machine operation data and performance data for analysis by said diagnostic engine to augment the analysis based on said banding defect analysis.

15. A system for diagnosing the cause of banding defects in a document processing system, as described in claim 14, wherein said machine data module further comprises:

a machine interface for connection of said machine data module to at least one component of said document processing system to send and receive signals to and from said document processing system relating to performance of said system;

a machine test module for invoking/executing predetermined performance tests or diagnostic tests on said document processing system to generate at least a portion of said machine data;

a machine data processor for compiling and extracting said machine data features and sending said data to said diagnostic engine.

16. A system for diagnosing the cause of banding defects in a document processing system, as described in claim 15, wherein said machine test module further stores and runs said performance tests or diagnostic tests on said document processing system.

17. A system for diagnosing the cause of banding defects in a document processing system, as described in claim 15, wherein said machine data processor module applies a series of algorithms which utilize predetermined parameters to generate machine data features.

18. A system for diagnosing the cause of banding defects in a document processing system, as described in claim 17, wherein said algorithms are based on statistical analysis and data mining techniques.

19. A system for diagnosing the cause of banding defects in a document processing system, as described in claim 17, wherein said diagnostic system memory stores data relating to causes of banding defects correlated to machine data features indicative of said causes, for use by said diagnostic engine in the identification of said one or more malfunctions.

20. A system for diagnosing the cause of banding defects in a document processing system, as described in claim 15, wherein said diagnostic system memory has data stored therein relating to machine data, and a series of algorithms for generating features from said machine data, where said algorithms utilize a set of predetermined parameters.

21. A diagnostic system for diagnosing the cause of banding defects in a document processing system comprising:

a scanner for generating image data by digitizing hardcopy samples obtained by printing or copying a test pattern on said document processing system an image quality analysis module adapted to receive said image data and to detect the presence of banding defects, said image quality analysis module further analyzing said image data relating to a detected banding defect to obtain quantified parameters of said banding defect and extracting key features from said quantified parameters;

a diagnostic engine adapted to receive and analyze said key features, said diagnostic engine further identifying one or more malfunctions which are possible causes of said defect based on said analysis of said key features;

a repair planning module adapted to receive the malfunctions identified by said diagnostic engine and select, from a plurality of service procedures, one or more of said procedures which are likely to correct said malfunction;

a memory module for storing data and algorithms relating to said diagnostic system;

a diagnostic control module adapted to control and coordinate the operation of said modules;

a machine data module for compiling machine operation data and performance data for analysis by said diagnostic engine to augment the analysis based on said banding defect analysis; and a test selection module that determines the next test pattern to be scanned or the next machine test to be run and the next set of features to be evaluated during successive diagnostic process cycles.

22. A system for diagnosing the cause of banding defects in a document processing system, as described in claim 21, wherein said memory stores data relating to causes of banding defects correlated to tests capable of isolating said causes, for use by said test selection module in the choice of the test to be performed.

23. A system for diagnosing the cause of banding defects in a document processing system, as described in claim 1, wherein said image quality analysis module further comprises:

a banding defect analyzer for analyzing said image data and calculating said banding defect quantified parameters; and a feature extraction processor for executing a series of algorithms comparing said parameter values of said banding defect analysis to predetermined thresholds and device specific specifications to identify said key features of said banding defect.

24. A system for diagnosing the cause of banding defects in a document processing system, as described in claim 1, wherein said diagnostic engine selects said malfunctions by comparing said probability of causation for a malfunction to a predetermined certainty threshold.

25. A diagnostic system for diagnosing the cause of banding defects in a document processing system comprising:

a scanner for generating image data by digitizing hardcopy samples obtained by printing or copying a test pattern on said document processing system an image quality analysis module adapted to receive said image data and to detect the presence of banding defects, said image quality analysis module further analyzing said image data relating to a detected banding defect to obtain quantified parameters of said banding defect and extracting key features from said quantified parameters;

a diagnostic engine adapted to receive and analyze said key features, said diagnostic engine further identifying one or more malfunctions which are possible causes of said defect based on said analysis of said key features;

a repair planning module adapted to receive the malfunctions identified by said diagnostic engine and select, from a plurality of service procedures, one or more of said procedures which are likely to correct said malfunction;

a memory module for storing data and algorithms relating to said diagnostic system;

a diagnostic control module adapted to control and coordinate the operation of said modules; and a user interface module adapted to receive information from the user that characterizes the banding defects observed by the user.

26. A system for diagnosing the cause of banding defects in a document processing system, as described in claim 25, further comprising a preprocessor for compiling said user input data and sending said data to said diagnostic engine.

27. A method for diagnosing the cause of banding defects in a document processing system comprising the steps of:

producing a hardcopy print or copy sample of an original hardcopy or digital test pattern on said document processing system;

generating digital image data from said hardcopy print or copy sample;

analyzing said image data to detect the presence of banding defects;

analyzing the image data to obtain quantified parameters characterizing said banding defect;

extracting key features from said banding defect quantified parameters;

identifying one or more malfunctions which are possible causes of said defect by analysis of said key features through iterative cycles of analysis based on one or more test patterns;

selecting, from a plurality of service procedures, one or more of said procedures which are likely to correct said identified one or more malfunctions.

28. A method for diagnosing the cause of banding defects in a document processing system, as described in claim 27, further comprising the step of causing said selected service procedure to be automatically performed in said document control system.

29. A method for diagnosing the cause of banding defects in a document processing system, as described in claim 27, further comprising the step of presenting to a user said selected service procedure to be performed in said document. control system.

30. A method for diagnosing the cause of banding defects in a document processing system, as described in claim 27, wherein said step of generating banding defect quantified parameters is accomplished by applying one or more methods selected from the group consisting of a fourier analysis, band pass filtering and visual perception analysis to said image data.

31. A method for diagnosing the cause of banding defects in a document processing system, as described in claim 27, wherein the step of extracting key features comprises applying a series of algorithms on said quantified parameters, wherein said algorithms use predetermined threshold values for said parameters and device specific specifications.

32. A method for diagnosing the cause of banding defects in a document processing system, as described in claim 27, wherein said step of identifying malfunctions comprises applying reasoning techniques on said key features.

33. A method for diagnosing the cause of banding defects in a document processing system, as described in claim 27, wherein said step of identifying malfunctions comprises calculating the probability of causation of a plurality of malfunctions in said system for said key features.

34. A method for diagnosing the cause of banding defects in a document processing system, as described in claim 27, wherein said step of calculating said probabilities of causation comprises applying a bayesian analysis to said key features.

35. A method for diagnosing the cause of banding defects in a document processing system, as described in claim 27, wherein said step of extracting key features further comprises the steps of:

storing data relating to banding defects, comprising predetermined threshold values and device specific specifications; and applying a series of algorithms to said banding defect quantified parameters which utilize said stored data to extract said key features.

36. A method for diagnosing the cause of banding defects in a document processing system, as described in claim 27, further comprising the step of storing data relating to causes of banding defects correlated to banding defect features indicative of said causes, for use by said diagnostic engine in the identification of said one or more malfunctions.

37. A method for diagnosing the cause of banding defects in a document processing system, as described in claim 27, further comprising the step of compiling machine data, for analysis by said diagnostic engine to augment the analysis based on said banding defect analysis output.

38. A method for diagnosing the cause of banding defects in a document processing system, as described in claim. 37, further comprising the steps of:

sending and receiving signals to and from said document processing system relating to performance of said system;

running predetermined performance or diagnostic tests on said document processing system to generate at least a portion of said machine data;

analyzing said machine data using a series of algorithms to extract machine data features; and compiling said machine data features and sending said features to said diagnostic engine.

39. A method for diagnosing the cause of banding defects in a document processing system, as described in claim 27, wherein said step of selecting probable malfunctions comprises the step of comparing said probability of causation for a malfunction to a predetermined certainty threshold.

40. A method for diagnosing the cause of banding defects in a document processing system, as described in claim 37, further comprising the step of storing said performance or diagnostic tests.

41. A method for diagnosing the cause of banding defects in a document processing system, as described in claim 37, further comprising the said step of analyzing said machine data using a series of algorithms that utilize predetermined parameters to generate machine data features.

42. A method for diagnosing the cause of banding defects in a document processing system, as described in claim 37, wherein said step of generating machine data uses algorithms based on statistical analysis and data mining techniques.

43. A method for diagnosing the cause of banding defects in a document processing system, as described in claim 27, further, comprising the said step of selecting a series of tests to be performed correlated to features to be evaluated.

44. A method for diagnosing the cause of banding defects in a document processing system, as described in claim 42, further comprising the said step of storing data relating to causes of banding defects correlated to tests capable of providing banding defect or machine data features indicative of said causes, for use in the choice of the tests to be performed.

45. A method for diagnosing the cause of banding defects in a document processing system comprising the steps of:

producing a hardcopy print or copy sample of an original hardcopy or digital test pattern on said document processing system;

generating digital image data from said hardcopy print or copy sample;

analyzing said image data to detect the presence of banding defects;

analyzing the image data to obtain quantified parameters. characterizing said banding defect;

extracting key features from said banding defect quantified parameters;

identifying one or more malfunctions which are possible causes of said defect by analysis of said key features;

selecting, from a plurality of service procedures, one or more of said procedures which are likely to correct said identified one or more malfunctions; and entering data through a user interface characterizing the banding defects observed by the user.

46. A method for diagnosing the cause of banding defects in a document processing system, as described in claim 45, wherein the said step of entering data through the user interface further includes the step of preprocessing said data and considering said user entered data in the analysis of said image data.

47. A method for diagnosing the cause of banding defects in a document processing system comprising the steps of:

producing a hardcopy print or copy sample of an original hardcopy or digital test pattern on said document processing system;

generating digital image data from said hardcopy print- or copy sample;

analyzing said image data to detect the presence of banding defects;

analyzing the image data to obtain quantified parameters characterizing said banding defect;

extracting key features from said banding defect quantified parameters;

identifying one or more malfunctions which are possible causes of said defect by analysis of said key features;

selecting, from a plurality of service procedures, one or more of said procedures which are likely to correct said identified one or more malfunctions; and determining the next test pattern to be printed or copied and then scanned and the next set of features to be evaluated during successive diagnostic process cycles.

48. A method for diagnosing the cause of banding defects in a document processing system, as described in claim 47, further comprising the step of storing data relating to causes of banding defects, correlated to test patterns capable of providing banding defect features indicative of said causes, for use in the choice of the test pattern to be scanned.

49. A method for diagnosing the cause of banding defects in a document processing system, as described in claim 27, further comprising the step of storing data relating to causes of banding defects correlated to machine data features indicative of said causes, for use by said diagnostic engine in the identification of said one or more malfunctions.

* * * * *